United States Patent [19]

Setani

[11] 4,249,586

[45] Feb. 10, 1981

[54] GOLF BAG

[76] Inventor: Yosuke Setani, 3-8, 3-chome, Koji-machi, Chiyoda-ku, Tokyo, Japan

[21] Appl. No.: 73,641

[22] Filed: Sep. 10, 1979

[30] Foreign Application Priority Data

Sep. 13, 1978 [JP] Japan ..... 53-125761[U]

[51] Int. Cl.[3] ..... A63B 55/00

[52] U.S. Cl. ..... 150/1.5 C

[58] Field of Search ..... 150/1.5 C, 1.5 R, 1.5 B

[56] References Cited

U.S. PATENT DOCUMENTS

| | | | |
|---|---|---|---|
| 1,437,349 | 11/1922 | Moore | 150/1.5 R |
| 2,861,614 | 11/1958 | Kish | 150/1.5 R |
| 3,521,689 | 7/1970 | Woods | 150/1.5 R |
| 3,674,072 | 7/1972 | Shuto | 150/1.5 R |
| 3,901,299 | 8/1975 | Picco | 150/1.5 R |

FOREIGN PATENT DOCUMENTS

| | | | |
|---|---|---|---|
| 254609 | 5/1963 | Australia | 150/1.5 C |

*Primary Examiner*—Donald F. Norton

*Attorney, Agent, or Firm*—Holman & Stern

[57] ABSTRACT

A golf bag is provided of which members constituting the bag are separable and can be assembled with fastening members.

3 Claims, 4 Drawing Figures

GOLF BAG

BRIEF DESCRIPTION OF THE INVENTION

The present invention relates to a golf bag and in particular to a golf bag constructed in such a manner that each of the members constituting the bag is separable and can be fastened with fastening members.

A golf bag according to this invention is characterized in that the forming members such as the body, top forming ring, club head cover sheet, bottom receptacle, etc. are each separable from each other and assembled by means of fastening members.

This invention relates to improvements in a golf bag. Conventional golf bags have drawbacks in that they are bulky and require a very large space for storing and transportation resulting in the high costs of packaging and transporting them because of the fact that the body of the bag to which are attached a club head cover and a shoulder belt, etc. is formed integrally in one single cylindrical body.

The object of the present invention is to completely improve or reform the construction of said conventional golf bags of the prior art and to provide improved golf bags such that the constituting members thereof are each separately manufactured and detachably assembled by means of fastening members.

BRIEF DESCRIPTION OF SEVERAL VIEWS OF THE DRAWING

The accompanying drawings show one preferred embodiment of the golf bag according to this invention, wherein.

DETAILED DESCRIPTION

Figure 1:
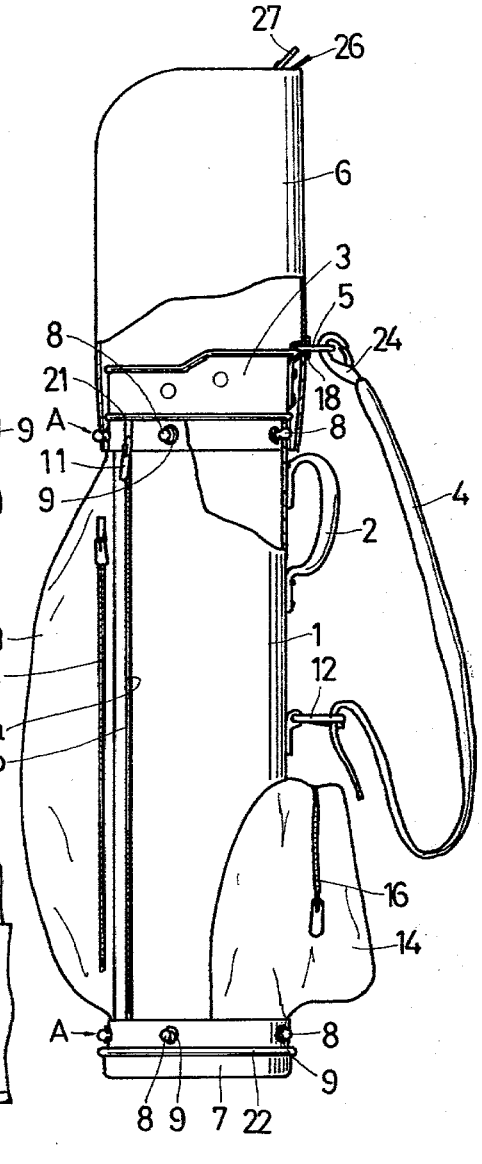
FIG. 1 is a side view of a golf bag with a club head cover a part thereof being cut off.
Figure 2:
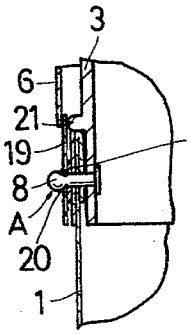
FIG. 2 is a partial longitudinal side sectional view showing the construction wherein the cover sheet is secured to the flat plate-like body.
Figure 3:
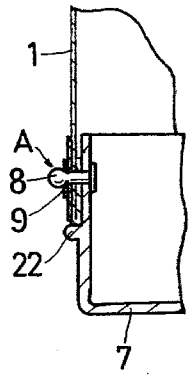
FIG. 3 is a longitudinal side sectional view showing the state of the bottom receptacle and the flat plate-like body secured to each other.
Figure 4:
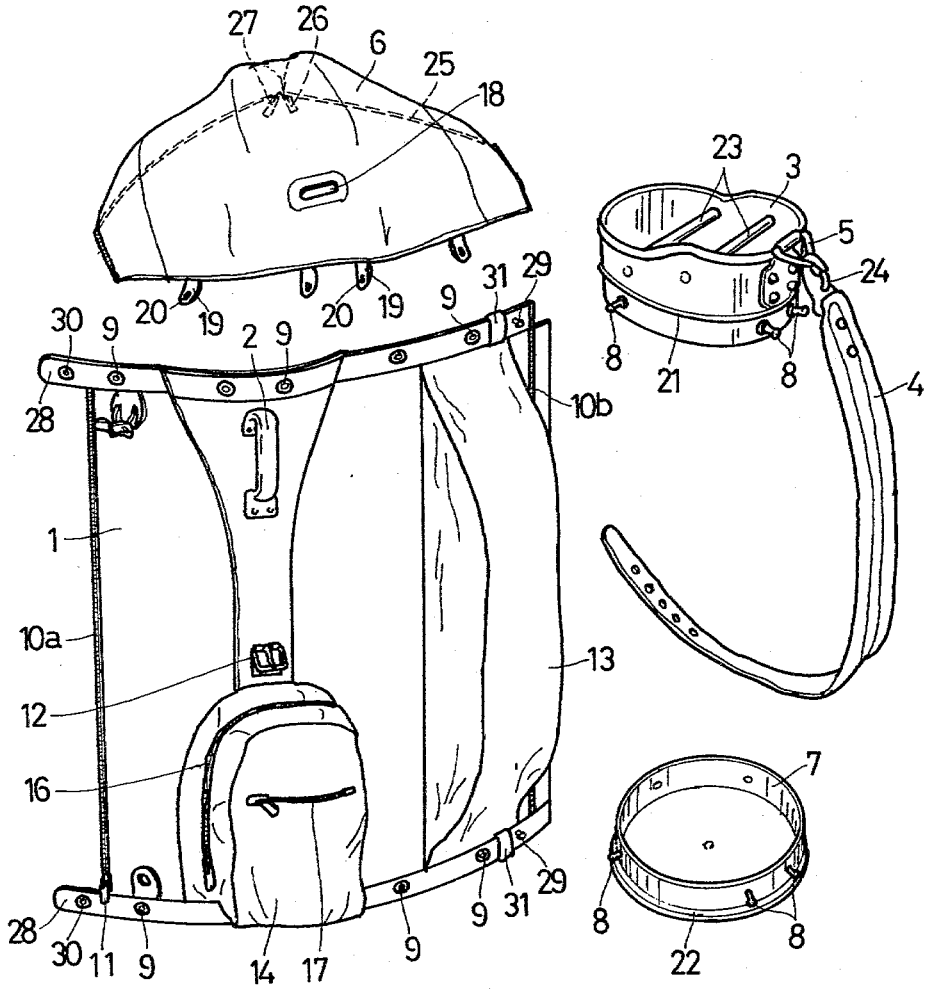
FIG. 4 is a perspective view of each disassembled component of a golf bag according to this invention.

The invention will now be described with reference to the accompanying drawings by way of a preferred embodiment, wherein the reference numeral 1 is a flat plate-like body with a handle 2 attached thereto, 3 is a top end form-retention ring to which the hook ring 5 of a shoulder belt 4 is secured, 6 is a cover sheet for covering the golf club heads projecting upwardly from the top end form-retention ring 5, and 7 is a bottom receptacle.

According to the present invention, each of the above-indicated components is prepared as a separate item so as to be detachably assembled with a plurality of fasteners A, and in the embodiment shown herein the projections 8 provided on the peripheral surfaces of the top end form-retention rings 3 and the bottom receptacle 7 as well as the insertion rings 9 secured to the upper and lower edges of the flat plate-like body 1 serve as fasteners A.

On both right and left side edges of the flat plate-like body 1 there are provided the two rows of slide fasteners 10*a*, 10*b* of a zipper for engagement with each other and a slider 11 is installed on the row 10*a* so that the flat plate-like body can be formed into a cylindrical body by moving the slider 11 along the mating edges of the rows 10*a* and 10*b*.

12 is a buckle attached substantially to the central portion of the body 1 for the shoulder belt 4. 13 and 14 are large and small pockets respectively provided on the flat plate-like body 1 with zippers 15, 16 and 17. 18 Is a slot formed on the cover sheet 6 for insertion of the shoulder belt 4.

19 is one of a plurality of tabs each formed with a hole 20 provided on the lower edge of the cover sheet 6 through which projections 8 are inserted. Projections 8 are provided on the peripheral surfaces of the top end form-retention ring 3 and the bottom receptacle 7 and there are also provided projecting edges 21, 22 which are to be abutted in the assembled position with the upper and lower edges of the flat plate-like body 1, respectively.

23 Indicates club supporting rods, 24 is a snap hook, and 25 is a zipper member attached to the cover sheet 6. 26 And 27 are sliders of the zipper, 28 is a strap on each of the upper and lower edges of body 1 with small holes 30 for insertion of the projections 29 provided on the location adjacent the upper and lower edges of the flat plate-like body 1, and 31 is a belt loop provided on the other end of each strap for receiving the end portion of the strap.

According to the present invention, the components of the bag can be separated from each other and easily assembled by means of the fasteners A so that the cost for assembling is no more required and the manufacturing cost can therefore be reduced to a great extent as compared with that of conventional golf bags. In addition, the body of the bag is spreadable or openable as a flat plate-like one so that it has such advantages that it will not only be easy to sew name marks or labels thereon but also it will be possible to employ the body and other parts in different colors, thus enabling one bag to be used in various fashions by changing the parts with ones suitable, for example, for ladies, or with ones having a large pocket made of leather or the like.

Conventional golf bags are very uneconomical in that they tend to be abandoned when they are partly damaged. According to the present invention, however, the bags are easily repaired because of the interchangeability of their components, thus affording great usefulness.

What is claimed is:

1. A golf bag comprising a flat plate-like body having top, bottom and side edges, a zipper slide fastener secured to said side edges of said body to retain said body in cylindrical form when closed, a handle attached to said body near said top edge, a top end form-retention ring, a hook ring attached to the outer peripheral surface of said top ring, a dish-shaped bottom member, a cover sheet for covering golf club heads projecting from said top end form-retention ring, fastener means to detachably connect said top end form-retention ring, bottom member and cover sheet to said body comprising projections on the peripheral surfaces of said top end form-retention ring and bottom member and cooperating connecting rings on said top and bottom edges of said body and on said cover through which said projections are removably insertable, a belt-type buckle secured to the outer surface of said body substantially at the central portion thereof, and a shoulder strap having a snap hook at one end for engaging said hook ring and a belt-type portion at the other end for engaging with said buckle.

2. A golf bag claimed in claim 1 wherein said flat plate-like body is provided with large and small pockets.

3. A golf bag as claimed in claim 1 wherein said projections of said fastening means are provided with twisting members on their ends to further secure said projections in said connecting rings.

* * * * *